US006863081B2

(12) United States Patent
Hsieh

(10) Patent No.: US 6,863,081 B2
(45) Date of Patent: Mar. 8, 2005

(54) WIND-PROOF UMBRELLA RIB STRUCTURE

(76) Inventor: Ming-Ju Hsieh, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/357,074

(22) Filed: Feb. 4, 2003

(65) Prior Publication Data

US 2004/0149326 A1 Aug. 5, 2004

(51) Int. Cl.[7] ..... A45B 25/00

(52) U.S. Cl. ..... 135/29; 135/25.3; 135/25.31; 135/31

(58) Field of Search ..... 135/25.3, 25.31, 135/25.32, 31, 27, 29

(56) References Cited

U.S. PATENT DOCUMENTS 4,007,752 A * 2/1977 Weber ..... 135/25.31
6,089,244 A * 7/2000 Ko ..... 135/33.7
6,186,157 B1 2/2001 Lin et al.
6,244,284 B1 * 6/2001 Wang ..... 135/31
2002/0129843 A1 * 9/2002 Wang ..... 135/29
2003/0005951 A1 * 1/2003 Wu ..... 135/27
2003/0205264 A1 * 11/2003 Lin et al. ..... 135/31

* cited by examiner

*Primary Examiner*—Leslie A. Braun
*Assistant Examiner*—Amy J. Sterling

(57) ABSTRACT

A wind-proof umbrella rib structure comprises a main rib, a plurality of sub-ribs and an umbrella cloth. An annular upper nest is at a top of the main rib and a lower nest is at a middle section of the main rib. Each sub-rib includes an upper rib, a lower rib, a tension rib, a driven rib, a connecting rib; and a pivotal piece. Each pivotal piece has a first slot and a second slot. When one end of the lower rib is pivotally to a tension rib, a stud passes through the lower rib, the first slot and the tension rib so as to fix the lower rib. The second slot serves to connect the first and second driven means. The umbrella cloth includes a first cloth and a second cloth. The first and second cloths are overlapped. The overlapped portions are formed with gaps as flow guides.

1 Claim, 8 Drawing Sheets

A-A

WIND-PROOF UMBRELLA RIB STRUCTURE

FIELD OF THE INVENTION

The present invention relates to umbrellas, and particularly to a wind-proof umbrella rib structure.

BACKGROUND OF THE INVENTION

Referring to FIG. 1, in the prior art, umbrella ribs are usually turned over due to strong wind. To improve the defect in the prior art, an improvement is disclosed in U.S. Pat. No. 6,186,157, as illustrated in Fige In this prior art, the umbrella is formed by a rod and umbrella ribs, umbrella cloth, a pull rod and a rope. The connection of the pull rod and the ropes will pull the top ribs to move inwards so as to prevent the umbrella ribs from turning over. However, in this prior art, the connection of the pull rod and ropes easily loosen. Or the ribs are too long to be secured by the connection of pull rod and ropes so that as wind is too strong, the umbrella ribs will bend. Thereby, this prior art can not effectively improve the defects in the prior art.

SUMMARY OF THE INVENTION

Accordingly, the primary object of the present invention is to provide a wind-proof umbrella rib structure; wherein a pivotal piece is formed by two pieces. Each pivotal piece has a first slot and a second slot. When one end of the lower rib is pivotally to a tension rib so as to fix the lower rib. The second slot serves to connect the first and second driven means.

Another object of the present invention is to provide a wind-proof umbrella rib structure, wherein the umbrella cloth includes a first cloth and a second cloth. The feature of the umbrella cloth is that the first and second cloths are overlapped. The overlapped portions are formed with gaps as flow guides.

The various objects and advantages of the present invention will be more readily understood from the following detailed description when read in conjunction with the appended drawing.

DETAILED DESCRIPTION OF THE PREFERRED EMBODIMENTS

Figure 1:
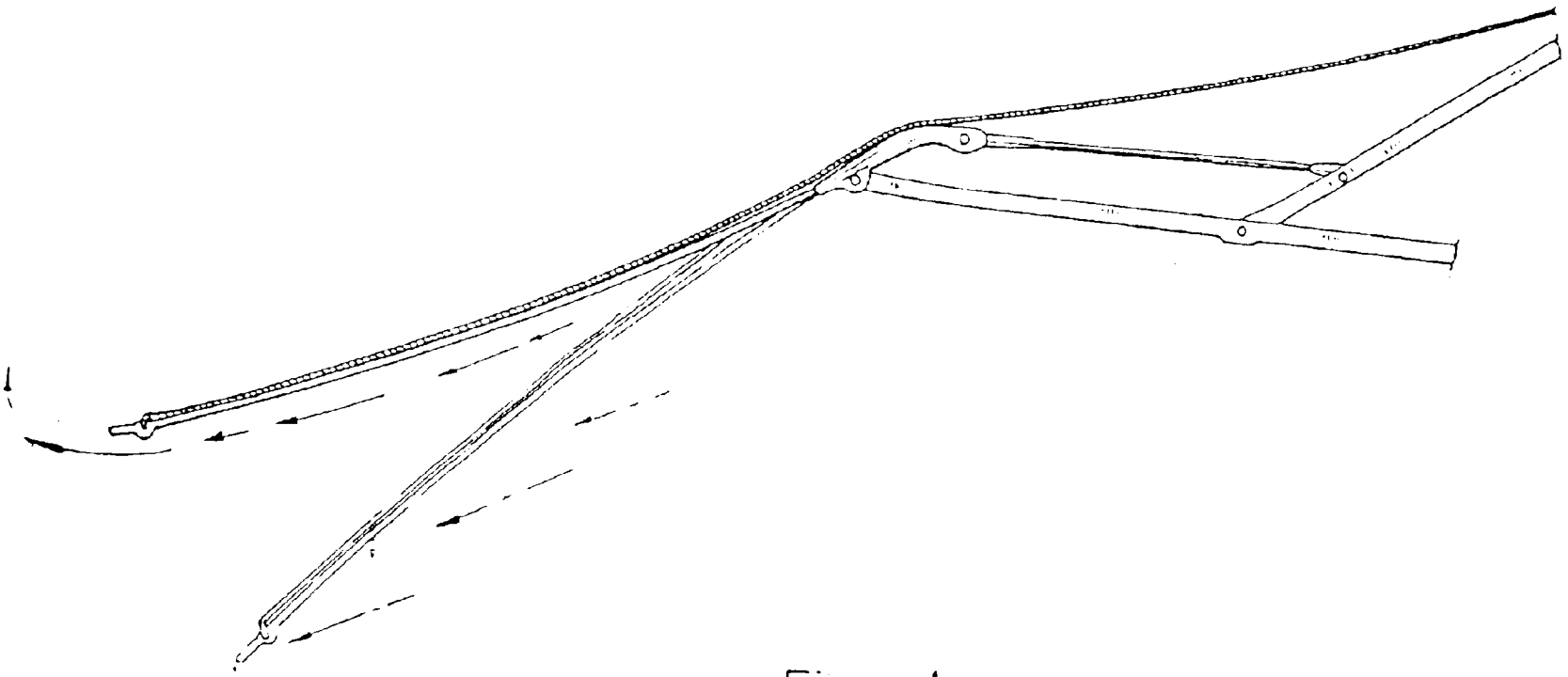
Fig. 1 PRIOR ART
FIG. 1 is a schematic view of a prior art umbrella.
Figure 2:
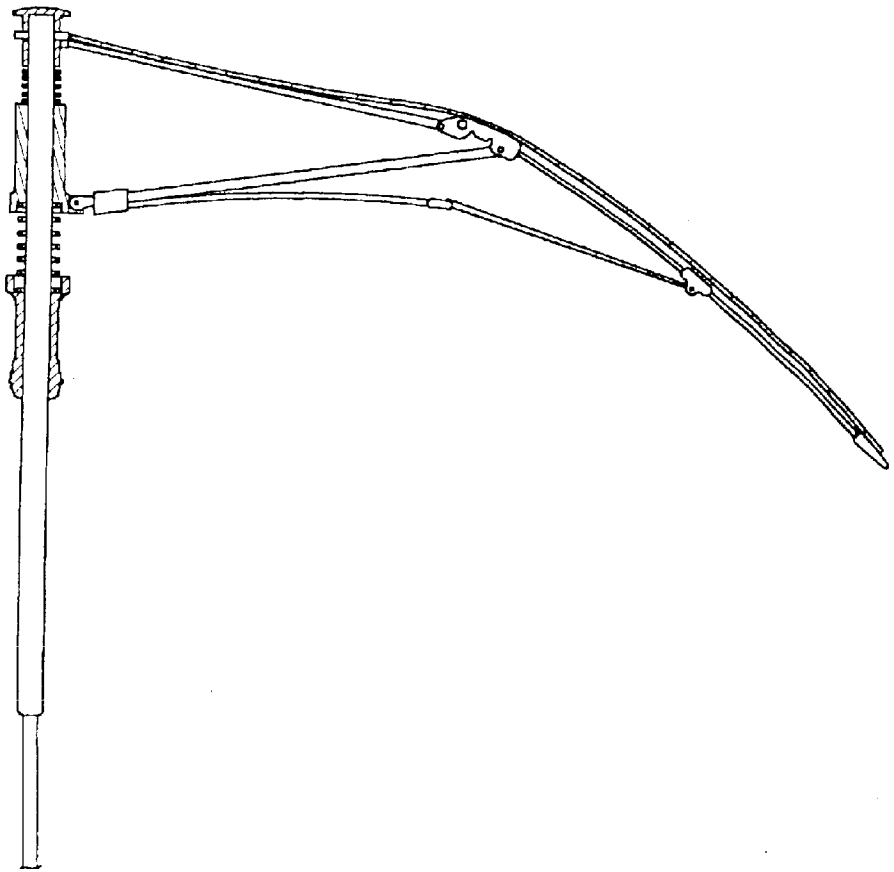
Fig.2 PRIOR ART
FIG. 2 is a schematic view of another prior art umbrella.
Figure 3:
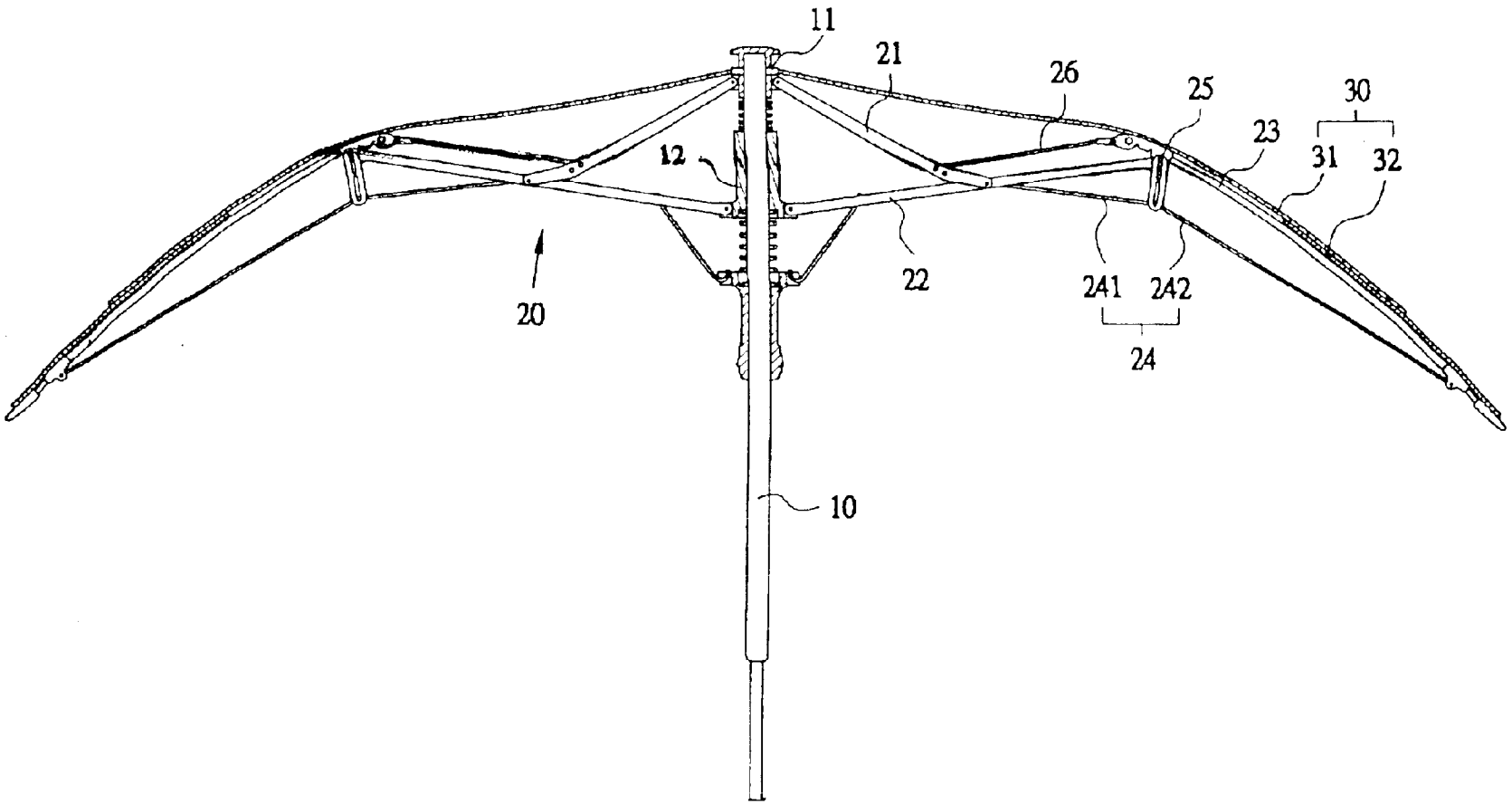
FIG. 3 is an assembled schematic view of the present invention.
Figure 4:
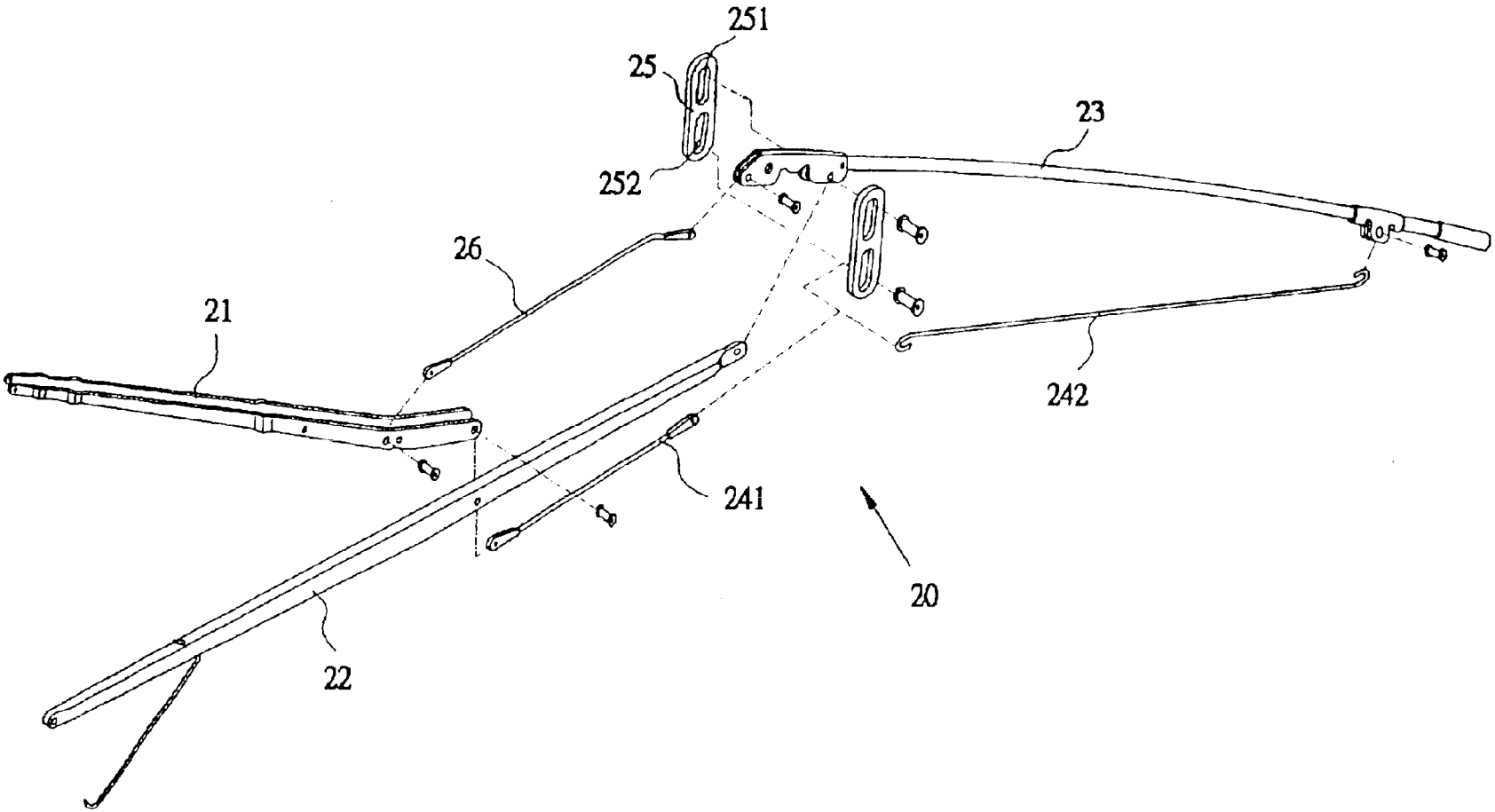
FIG. 4 is an exploded schematic view showing the sub-rib of the present invention.
Figure 5:
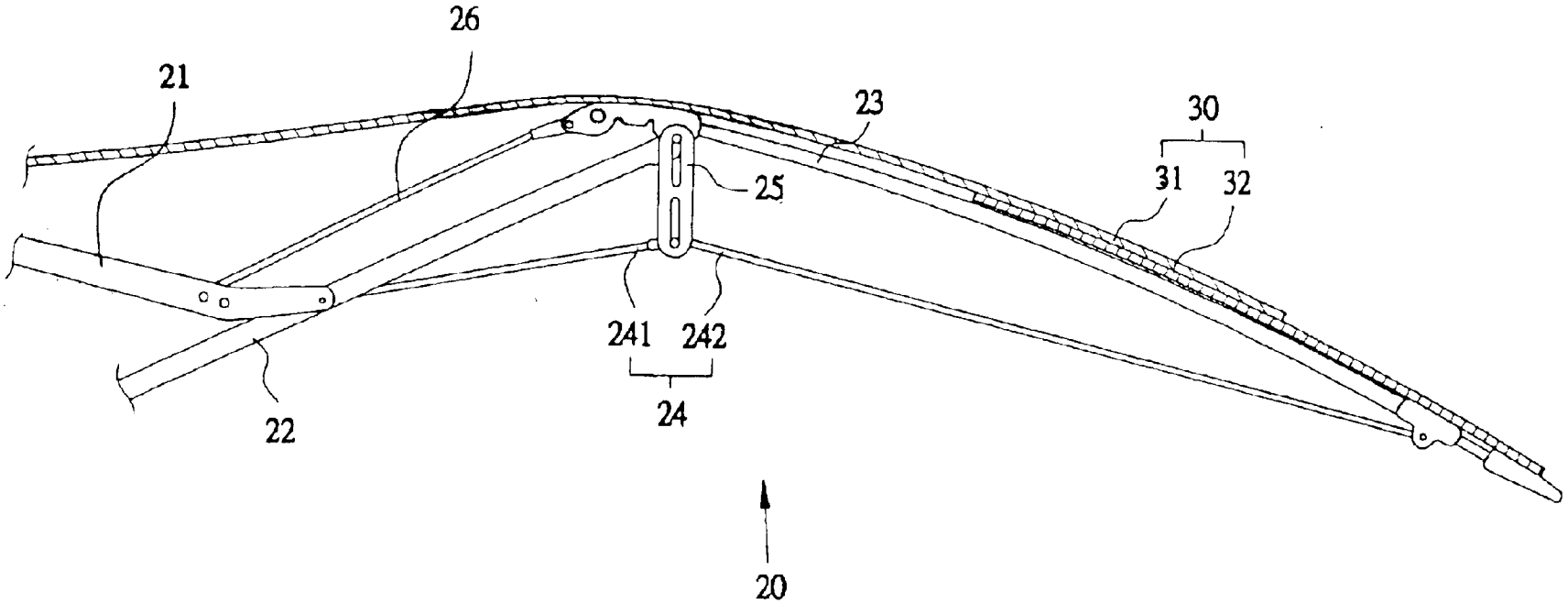
FIG. 5 is a partial assembled cross sectional view of the present invention.

Referring to FIGS. 3 to 5, the wind-proof umbrella rib structure of the present invention is illustrated. The wind-proof umbrella rib structure comprises a main rib 10, a plurality of sub-ribs 20 and an umbrella cloth 30.

The main rib 10 has an annular upper nest 11 at a top of a rod body and a lower nest 12 at a middle section of the rod body. The upper nest 11 and lower nest 12 are formed with respective pivotal portions. Thereby, the upper and lower nest 12, 12 can be pivotally installed by one end of each sub-rib 20.

Each sub-rib 20 includes an upper rib 21, a lower rib 22, a tension rib 23, a driven rib 24, and a connecting rib 26, a pivotal piece 25.

An inner end of the upper rib 21 is pivotally mounted to the upper nest 11 and an outer end thereof is pivotally installed to a middle section of the lower rib 22.

The lower rib 22 is a straight rod. An inner end of the lower rib 22 is pivotally installed to an outer periphery of the lower nest 12 and an outer end of the lower rib 22 is pivotally installed to an end of the tension rib 23.

The tension rib 23 is an elastic means and is pivotally installed to an outer end of a respective sub-rib 20.

The driven rib 24 is formed by a first driven means 241 and a second driven means 242. The first driven means 241 can have a rigid structure. The second driven means 242 has a rigid structure. An inner end of the driven rib 24 is pivotally to a middle section of the upper rib 21 and an outer end thereof is pivotally installed to the outer end of the tension rib 23.

The pivotal piece 25 is an important means of the present invention. The pivotal piece 25 is formed by two pieces. Each pivotal piece 25 has a first slot 251 and a second slot 252. When one end of the lower rib 22 is pivotally to the tension rib 23, the stud passes through the lower rib 22, the first slot 251 and the tension rib 23 so as to fix the lower rib 22. The second slot 252 serves to connect the first and second driven means 241 and 242.

An inner end of a connecting rib 26 is pivotally mounted to an outer end of the upper rib 21 and another end of the connecting rib 26 is pivotally mounted to an inner end of the tension rib 23.

The umbrella cloth 30 includes a first cloth 31 and a second cloth 32. An inner periphery of the first cloth 31 is pivotally installed to the upper nest 11 at the top of the main rib 10. An outer periphery of the first cloth 31 and an inner periphery of the second cloth 32 are firmly secured to an inner periphery of the tension rib 23 by winding wires. An outer periphery of the second cloth 32 is firmly secured to an outer end of the tension rib 23. The feature of the umbrella cloth 30 is that the first and second cloths 31, 32 are overlapped. The overlapped portions are formed with gaps as flow guides 33.

Thereby, by above components, the umbrella is stronger. Moreover, the flow guides have the advantages of guiding airflow so that the umbrella cloth 30 will not turn out due to a strong breeze.

Figure 6:
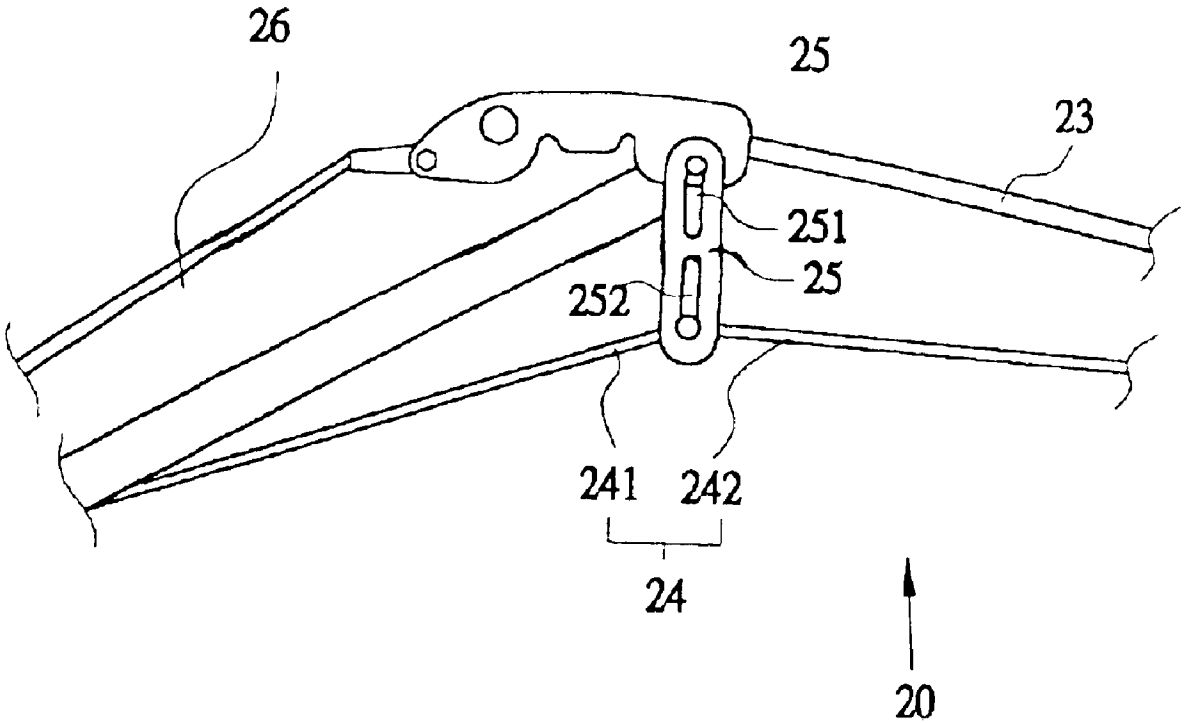
FIG. 6 is a partial enlarged schematic view of the present invention.

Referring to FIG. 6, a movable pivotal piece 25 is pivotally installed between the driven rib 24 of each sub-rib 20 and the tension rib 23. Thereby, in folding the umbrella, the driven rib 24 will not be harmed or deformed due to force applied thereon. Meanwhile, when a strong wind blows the umbrella, the pivotal piece 25 has the function of preventing the ribs from turning over.

Figure 7:
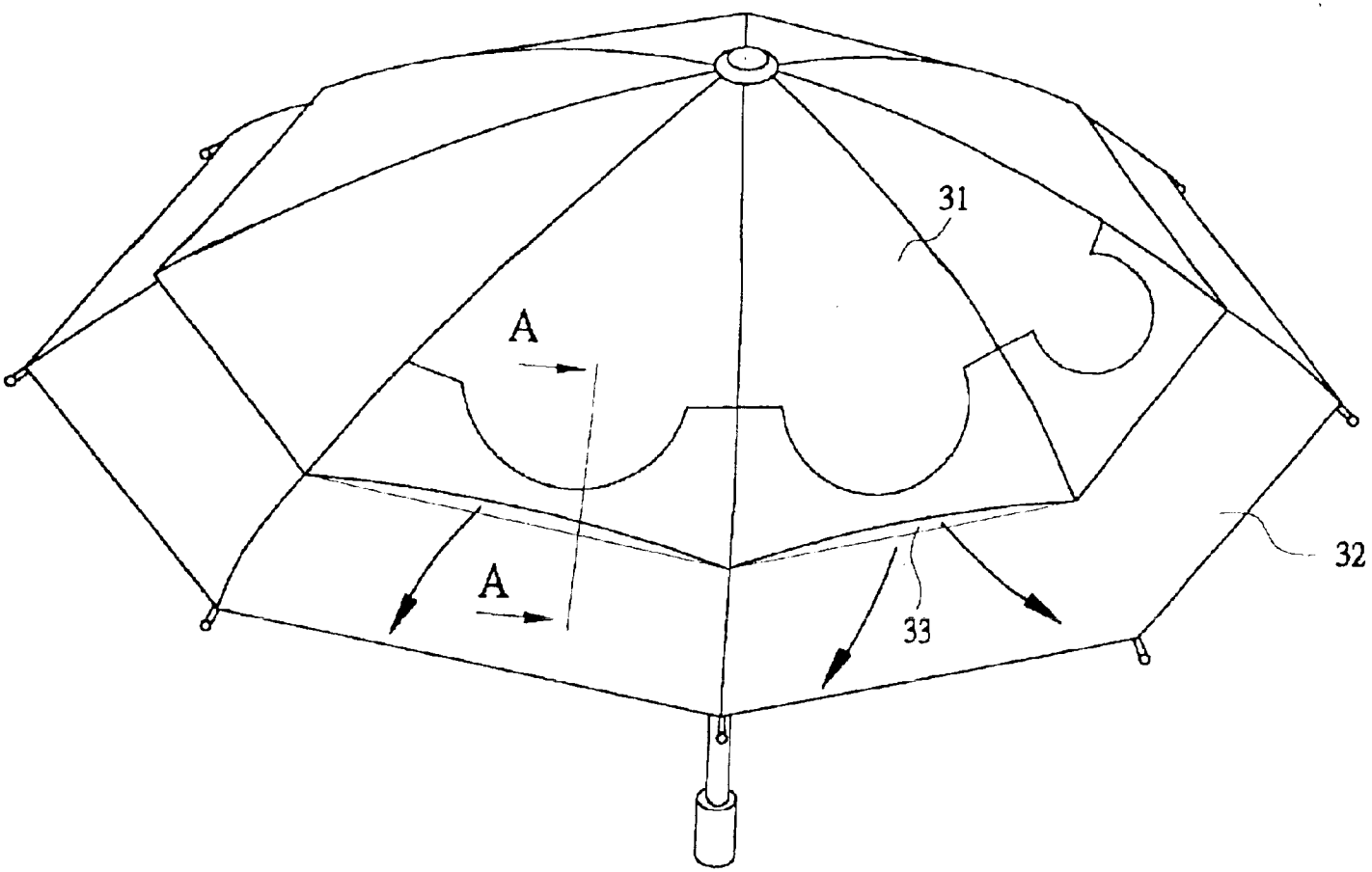
FIG. 7 shows one embodiment of the present invention for preventing the umbrella cloth from turning over.
Figure 8:
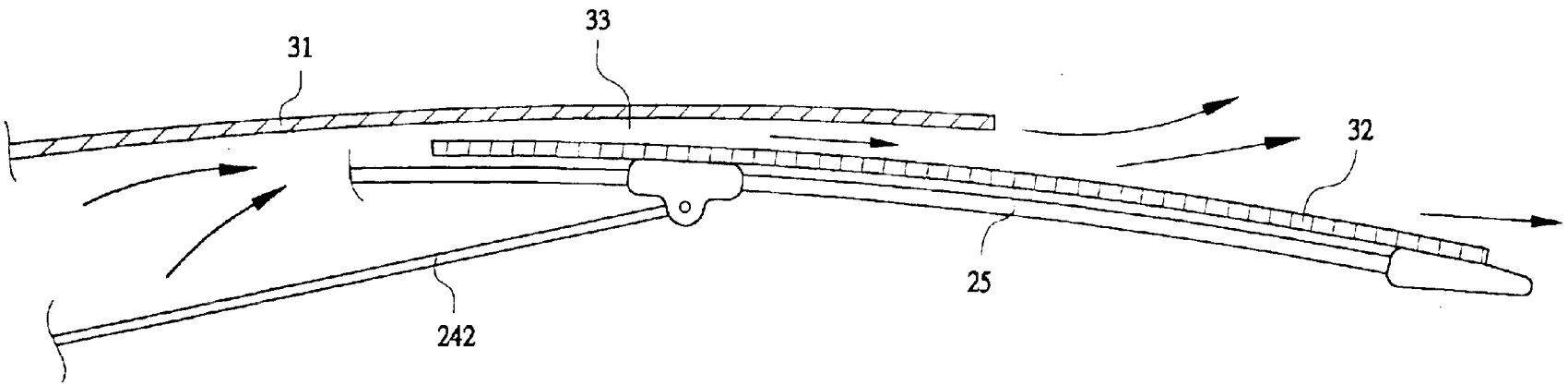
FIG. 8 is a partial schematic view of the embodiment of the present invention.

With reference to FIGS. 7 and 8, when strong wind blows the umbrella, since the flow guides of the umbrella cloth 30 can guide the wind so that the umbrella has a better wind-proof effect.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A wind-proof umbrella rib structure comprises a main rib, a plurality of sub-ribs and an umbrella cloth;

the main rib having a rod body; an annular upper nest being at a top of the rod body and a lower nest being at a middle section of the rod body; the upper nest and the lower nest being formed with respective pivotal portions; by this pivotal portions, the upper and lower nest being pivotally installed to one end of each sub-rib;

each sub-rib including an upper rib, a lower rib, a tension rib, a driven rib, a connecting rib; and a pivotal piece;

wherein the driven rib is formed by a first driven means and a second driven means;

an inner end of the upper rib being pivotally mounted to the upper nest and an outer end thereof being pivotally installed to a middle section of the lower rib;

an inner end of the lower rib being pivotally installed to an outer periphery of the lower nest and an outer end of the lower rib being pivotally installed to an end of the tension rib;

the tension rib being an elastic means and being pivotally installed to an outer end of a respective sub-rib;

an inner end of the driven rib and the outer end of the connecting rib being pivotally connected to a middle section of the upper rib; and an outer end of the driven rib being pivotally installed to the outer end of the tension rib;

an inner end of a connecting rib being pivotally mounted to a middle of the upper rib and another end of the connecting rib being pivotally mounted to an inner end of the tension rib;

the pivotal piece being formed by two pieces; each pivotal piece having a first slot and a second slot; when one end of the lower rib being pivotally attached to the tension rib, a stud passing through the lower rib, the first slot and the tension rib so as to fix the lower rib; the second slot serves for connecting the first and second driven means;

the umbrella cloth including a first cloth and a second cloth; an inner periphery of the first cloth being pivotally installed to the upper nest at the top of the main rib; an outer periphery of the first cloth and an inner periphery of the second cloth being firmly secured to an inner periphery of the tension rib; an outer periphery of the second cloth being firmly secured to an outer end of the tension rib; the first and second cloths being overlapped; the overlapped portions being formed with gaps as flow guides.

* * * * *